US010502427B2

(12) United States Patent
Donarski

(10) Patent No.: US 10,502,427 B2
(45) Date of Patent: Dec. 10, 2019

(54) GAS OVEN WITH ELECTRIC AND GAS HEATING ELEMENTS

(71) Applicant: WHIRLPOOL CORPORATION, Benton Harbor, MI (US)

(72) Inventor: Robert Scott Donarski, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 670 days.

(21) Appl. No.: 15/098,717

(22) Filed: Apr. 14, 2016

(65) Prior Publication Data

US 2016/0231001 A1 Aug. 11, 2016

Related U.S. Application Data

(63) Continuation of application No. 13/586,038, filed on Aug. 15, 2012, now Pat. No. 9,335,054.

(51) Int. Cl.

| | |
|---|---|
| ***F24C 1/04*** | (2006.01) |
| ***F24C 3/08*** | (2006.01) |
| ***F24C 7/06*** | (2006.01) |

(52) U.S. Cl.

CPC ..... *F24C 1/04* (2013.01); *F24C 3/087* (2013.01); *F24C 7/06* (2013.01); *F24C 7/062* (2013.01)

(58) Field of Classification Search

CPC ..... F24C 1/02; F24C 1/04
USPC ..... 392/307, 310
See application file for complete search history.

(56) References Cited

U.S. PATENT DOCUMENTS

| | | | | |
|---|---|---|---|---|
| 2,463,712 | A * | 3/1949 | Newell | F24C 3/128 126/39 G |
| 3,437,085 | A | 4/1969 | Perry | |
| 3,504,660 | A | 4/1970 | McArthur, Jr. et al. | |
| 3,703,988 | A | 11/1972 | Branson et al. | |
| 3,801,007 | A | 4/1974 | Branson et al. | |
| 3,806,700 | A | 4/1974 | Gilliom | |
| 3,813,078 | A | 5/1974 | Branson et al. | |
| 4,214,224 | A * | 7/1980 | Holtkamp | F24C 14/02 337/115 |
| 4,775,777 | A | 10/1988 | Sinn | |
| 6,201,222 | B1 | 3/2001 | Baker et al. | |
| 6,222,163 | B1 | 4/2001 | Maytag | |
| 6,943,324 | B2 | 9/2005 | Ahuja | |
| 6,966,582 | B1 | 11/2005 | Malone et al. | |
| 7,755,006 | B2 | 7/2010 | Jones et al. | |
| 7,759,617 | B2 | 7/2010 | Bowles et al. | |
| 8,138,453 | B2 | 3/2012 | Yang et al. | |
| 8,563,901 | B2 | 10/2013 | Hitchcock et al. | |
| 8,776,776 | B2 | 7/2014 | Todd et al. | |
| 2006/0090741 | A1 | 5/2006 | Bowles et al. | |

(Continued)

FOREIGN PATENT DOCUMENTS

| | | |
|---|---|---|
| EP | 1837598 A2 | 9/2007 |
| FR | 2887964 A1 | 5/2007 |

*Primary Examiner* — Jorge A Pereiro
(74) *Attorney, Agent, or Firm* — McGarry Bair PC

(57) ABSTRACT

An oven has a cooking cavity and a gas heating element provided at a lower portion of the cooking cavity and a low power electric heating element provided at an upper portion of the cooking cavity. Thermal radiation provided to the upper portion by the electric heating element combined with reflected thermal radiation provided from the gas heating element is enough to broil a food item in a predetermined broiling cycle of the oven.

20 Claims, 7 Drawing Sheets

(56) References Cited

U.S. PATENT DOCUMENTS

| | | | | |
|---|---|---|---|---|
| 2007/0278319 | A1 | 12/2007 | Jenkins et al. | |
| 2011/0091830 | A1 | 4/2011 | Trice et al. | |
| 2011/0290781 | A1 | 12/2011 | Burt et al. | |
| 2012/0168423 | A1* | 7/2012 | Hitchcock | F24C 3/128 219/391 |

* cited by examiner

GAS OVEN WITH ELECTRIC AND GAS HEATING ELEMENTS

CROSS REFERENCE TO RELATED APPLICATIONS

This application is a continuation of U.S. application Ser. No. 13/586,038 filed Aug. 15, 2012, now pending, and which is hereby incorporated by reference in its entirety.

BACKGROUND

Traditional gas cooking ovens often include a primary gas heating element beneath the cooking cavity for heating the air in the cooking cavity to cook or bake items in the cooking cavity according to a cooking or baking cycle. An additional gas heating element may be provided in an upper portion of the cooking cavity, within the cooking cavity, to heat items in the cooking cavity with direct heat. For example, a traditional gas cooking oven may include a gas heating element in an upper portion of the cooking cavity that provides a flame directly over the items in the cooking cavity to broil the items. The additional components required for providing a gas heating element in the upper portion of the cooking cavity for broiling add cost to the oven and takes up valuable space within the cooking cavity. Alternatively, an additional, smaller cooking cavity may be provided beneath the main cooking cavity and the primary gas heating element may be used to broil items placed in the additional cooking cavity, reducing the cost of oven by using a single gas heating element, but still reducing the space available for the cooking cavity.

BRIEF SUMMARY

In one aspect, embodiments of the invention relate to an oven having a housing defining a cooking cavity, a gas heating element only at a lower portion of the cooking cavity, and a low power electric heating element only at an upper portion of the cooking cavity as a radiation system. Thermal radiation provided to the upper portion by the electric heating element alone is not enough to broil a food item in a predetermined broiling cycle of the oven.

In another aspect, embodiments of the invention relate to an oven having a housing defining a cooking cavity, at least one gas heating element at a lower portion of the cooking cavity, an electric heating element at an upper portion of the cooking cavity as a radiation system, and a controller coupled to the at least one gas heating element and to the electric heating element. The controller is configured to control a cycle of operation wherein thermal radiation is emitted from a top portion of the housing at a broiling rate by activating at least the gas heating element; and thermal radiation is emitted from the electric heating element by activating the electric heating element wherein the thermal radiation from the top portion of the housing and the electric heating element form a combined thermal radiation greater than a thermal radiation from each of the top portion and the electric heating element individually.

In another aspect, embodiments of the invention relate to an oven having a housing defining a cooking cavity, at least one gas heating element at a lower portion of the cooking cavity, an electric heating element at an upper portion of the cooking cavity; and a controller coupled to the at least one gas heating element and to the electric heating element. The controller is configured to control a cycle of operation wherein the at least one gas heating element and the electric heating element are activated until a temperature in the cooking cavity reaches a preheating temperature in a preheating phase of the broiling cycle, wherein the electric heating element is activated and the gas heating element is selectively activated and deactivated to maintain an air temperature of the cooking cavity below a door-lock temperature in a broiling phase of the broiling cycle following the preheating phase, and the electric heating element is continuously activated during the broiling phase.

DETAILED DESCRIPTION

Figure 1:
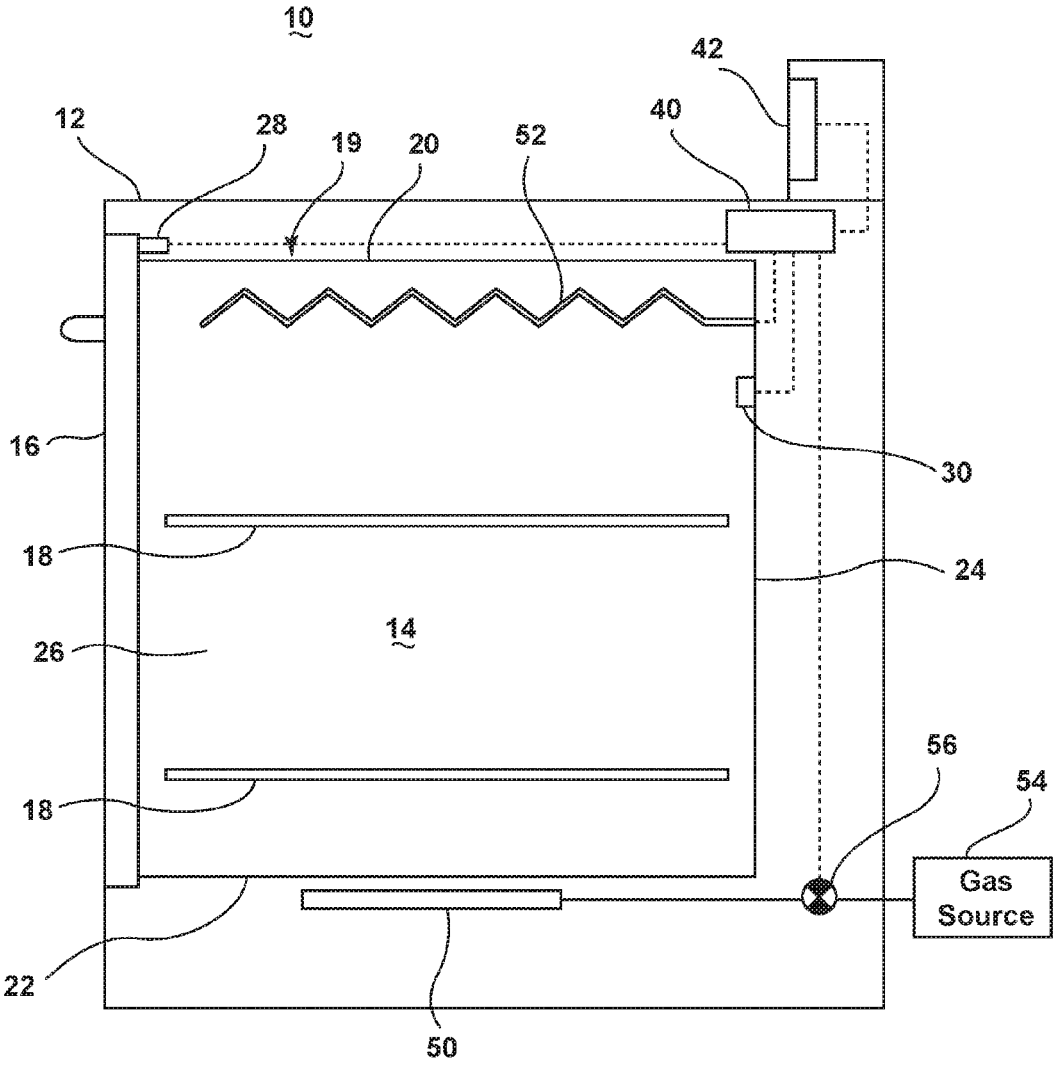
FIG. 1 is a cross-sectional, schematic side view of an oven having a gas heating element and an electric heating element according to one embodiment of the invention.

FIG. 1 illustrates an exemplary automatic household oven 10 for use in cooking, baking and/or broiling food items according to a cycle of operation. The oven 10 includes a cabinet 12 with an open-faced cooking cavity 14 and a door 16 that may be selectively opened and closed to provide access to the cooking cavity 14. One or more racks 18 may be selectively positioned within the cooking cavity 14 for supporting food items within the cooking cavity 14. The cooking cavity 14 may be defined by a housing 19 having an upper wall 20, a bottom wall 22, a rear wall 24 and a pair of opposing side walls 26. A door sensor 28 may be provided for detecting an open and closed position of the door 16. The cooking cavity may also be provided with a temperature sensor 30 for determining an air temperature within the cooking cavity 14.

The oven 10 may also include a controller 40 provided within the cabinet 12 that may communicate with a user through a user interface 42 for selecting a cycle of operation and controlling the operation of the oven to implement the selected cycle of operation.

The oven 10 also includes a heating system for heating the cooking cavity 14 according to a cycle of operation comprising a gas heating element 50 and an electric heating element 52. While the gas heating element 50 is illustrated as a linear strip and the electric heating element 52 is illustrated as a zig-zag line, these shapes are selected to visually differentiate the two types of heating elements and do not represent the actual shape of the heating elements.

The gas heating element 50 may be in the form of one or more conventional gas burner(s) connected to a source of gas 54 provided beneath the bottom wall 22 of the cooking cavity 14 such that heat from the gas heating element 50 conducts through the bottom wall 22 into the cooking cavity 14. Heat may also be conducted to the cooking cavity 14 through one or more vents in the cooking cavity 14 (not shown). A valve 56 may be provided between the lower gas heating element 50 and the gas source 54 to regulate the supply of gas to the gas heating element 50. The gas valve 56 may be moveable between a closed position where gas does not flow through the valve 56 and a fully open position in which gas flows through the valve at a maximum rate. Alternatively, the valve 56 may be a proportional valve, such as described in U.S. Pub. No. 20070278319 to Anthony E. Jenkins, filed May 15, 2006, and assigned to the present assignee, such that the gas may be controlled to flow through the valve 56 at flow rates other than the maximum rate.

The electric heating element 52 may be provided in an upper portion of the cooking cavity 14, spaced below the upper wall 20 of the cooking cavity 14, such that the electric heating element 52 projects into the cooking cavity 14. The electric heating element 52 may be mounted to the rear wall 24 of the cooking cavity 14, suspended from the upper wall 20 of the cooking cavity 14, and/or mounted to the side walls 26 of the cooking cavity 14. The mounting of the electric heating element 52 is not germane to the embodiments of the invention. The electric heating element 52 may be in the form of a resistive heating element that converts electrical energy into heat, as is known in the art.

Figure 2:
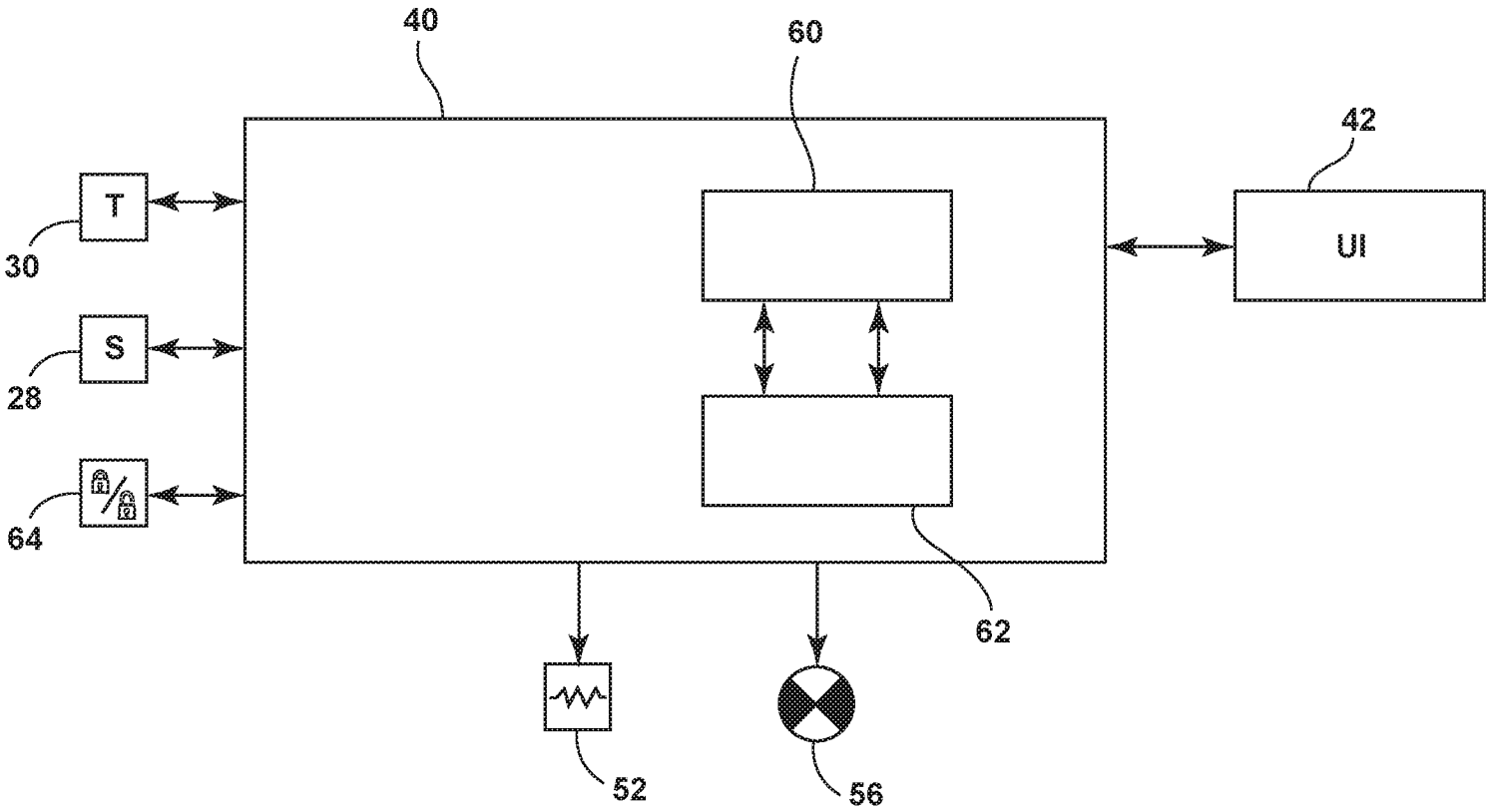
FIG. 2 is a schematic representation of a controller for controlling the operation of one or more components of the oven of FIG. 1 according to a second embodiment of the invention.

Referring now to FIG. 2, the controller 40 may be provided with a memory 60 and a central processing unit (CPU) 62. The memory 60 may be used for storing the control software that is executed by the CPU 62 in completing a cycle of operation using the oven 10 and any additional software. The memory 60 may also be used to store information, such as a database or table, and to store data received from the one or more components of the oven 10 that may be communicably coupled with the controller 40.

The controller 40 may be communicably and/or operably coupled with one or more components of the oven 10 for communicating with and controlling the operation of the component to complete a cycle of operation. For example, the controller 40 may be coupled with the gas valve 56 for controlling the heat output provided by the gas heating element 50 to the cooking cavity 14. The controller 40 may also be coupled with the electric heating element 52 for controlling the heat output provided to the cooking cavity 14 from the electric heating element 52. The controller 40 may also be coupled with the user interface 42 for receiving user selected inputs and communicating information to the user. For example, the user may select a temperature set point which the user desires the temperature of the cooking cavity 14 to reach or a cycle of operation which includes one or more temperature set points the temperature of the cooking cavity reaches during the course of the cycle of operation. Non-limiting examples of a cycle of operation include a pre-heating cycle, a cooking cycle, a baking cycle, a bread-proofing cycle, a defrost cycle, a warming cycle, a self-cleaning cycle, and a broiling cycle.

The controller 40 may also be coupled with a door lock 64 for selectively locking and unlocking the door 16 to limit access to the cooking cavity 14.

The controller 40 may also receive input from various sensors, such as the door sensor 28 for determining when the door 16 is in the opened or closed position, and the temperature sensor 30 for determining an air temperature within the cooking cavity 14. While the temperature sensor 30 is illustrated as a single temperature sensor, it is understood that more than one temperature sensor 30 may be provided in one or more locations within and/or adjacent to the cooking cavity 14 to determine the temperature within the cooking cavity 14.

The previously described oven 10 may be used to implement one or more embodiments of the invention. The embodiments of the method of the invention may be used to control the oven 10 to implement a broiling cycle using the gas heating element 50 and the electric heating element 52.

Heat transfer in an oven cavity is a combination of conduction, convection and thermal radiation. As used herein, conduction refers to a direct transfer of heat through a substance due to a temperature gradient. Convection refers to a diffusion of heat through a fluid, such as a liquid or a gas. Thermal radiation is a transfer of heat through the emission of electromagnetic radiation from one surface to another. As used herein, broiling refers to a method of cooking which uses a higher proportion of thermal radiation and a lower proportion of conductive and convective heat transfer to cook the food. Typically, the object of broiling is to brown the exterior of the food without overcooking the inside of the food.

Figure 3:
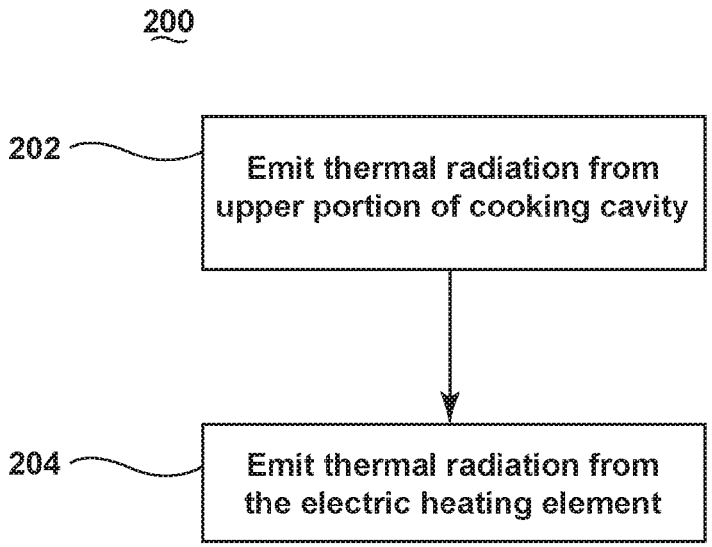
FIG. 3 is a flow chart illustrating an exemplary method for cooking items using an oven according to a third embodiment of the invention.

FIG. 3 illustrates a flow chart of a method 200 for implementing a broiling cycle using the gas heating element 50 and the electric heating element 52. The sequence of steps depicted for this method and the proceeding methods are for illustrative purposes only, and is not meant to limit any of the methods in any way as it is understood that the steps may proceed in a different logical order or additional or intervening steps may be included without detracting from the invention.

The method 200 starts with assuming that the user has placed one or more food items for broiling within the cooking cavity 14 and selected a broiling cycle of operation through the user interface 42. At 202, the cooking cavity 14 is heated such that at least a portion of the housing 19 defining the cooking cavity 14 emits thermal radiation into a broiling zone of the cooking cavity 14. The broiling zone may be defined as an upper portion of the cooking cavity 14 adjacent to the electric heating element 52 and including at least a portion of the upper rack 18 and the space between the electric heating element 52 and the upper rack 18. At 204, the electric heating element 52 may be activated to emit thermal radiation into the broiling zone of the cooking cavity 14.

The gas heating element 50 may be activated by the controller 40 by opening the gas valve 56 to heat the air in the cooking cavity 14 such that at least a portion of the housing 19 is heated by the heated air such that thermal radiation is emitted to the broiling zone. The upper wall 20, bottom wall 22, side walls 26, and rear wall 24 may all be heated such that they emit thermal radiation into the cooking cavity 14. The radiative heat transfer from one surface to another decreases with increasing distance between the two surfaces. Thus, portions of the upper wall 20 and upper portions of the side walls 26 and rear wall 24, which are adjacent to the broiling zone, are capable of emitting thermal radiation that will provide the greatest contribution to the thermal radiation emitted by the electric heating element 52 to broil a food item in the broiling zone. During broiling, direct heat is typically provided to the food item in the broiling zone from above the food item, thus the top portions of the housing 19, such as the upper wall 20 and upper portions of the side walls 26 and rear wall 24, and the electric heating element 52 contribute the greatest amount of thermal radiation to the food item to broil the food item. However, it will be understood that the thermal radiation from other portions of the housing 19 may also contribute to broiling the food item in the broiling zone.

The controller 40 may control the gas valve 56 such that the top portions of the housing 19 emit thermal radiation at a predetermined broiling rate based on the selected cycle of operation. As used herein, the broiling rate refers to thermal emission or radiation in watts per square inch. The electric heating element 52 may also be activated in combination with the gas heating element 50 to heat the top portions of the housing 19 such that the housing 19 emits thermal radiation at the predetermined broiling rate. Additionally, unlike the gas heating element 50, the electric heating element 52 may directly provide thermal radiation into the broiling zone in addition to heating the top portions of the housing 19.

The electric heating element 52 may be a lower power electric heating element such that activation of the electric heating element 52 during a cycle of operation does not overwhelm the power source. For example, the electric heating element 52 may be a 120 volt, 15 amp, 1500 watt resistive heater and thus have a much lower thermal output than the gas heating element 50. For example, the electric heating element 52 may have a thermal output of 10 watts/square inch. For this reason the thermal radiation provided to the broiling zone by the electric heating element 52 alone may not be enough to broil the food item as desired within a desired amount of time.

The temperature set point for the air temperature in the cooking cavity 14 and the duration of time at which the air temperature in the cooking cavity 14 is held at the temperature set point may be used to adjust the broiling rate of the thermal radiation emitted from the top portions of the housing 19. In one example, the temperature set point and the duration for heating the cooking cavity 14 with the gas heating element 50 corresponding to a predetermined broiling rate for thermal emission from the top portions of the housing 19 may be determined empirically and used to create a look-up table or algorithm which may be stored in the controller memory 60 and used by the controller 40 in completing a selected cycle of operation.

During the broiling cycle, the electric heating element 52 may be activated to emit thermal radiation in addition to the thermal radiation emitted from the top portions of the housing 19. The gas heating element 50 and the electric heating element 52 may be controlled by the controller 40 such that the combined thermal radiation emitted from the top portions of the housing 19 of the cooking cavity 14 and the electric heating element 52 is greater than the thermal radiation emitted from each of the top portions of the housing 19 and the electric heating element 52 individually. In this manner, both the gas heating element 50 and the electric heating element 52 may be controlled to provide the oven 10 with a radiation system to complete a broiling cycle.

An exemplary broiling rate for a conventional electric oven which utilizes only an electric broiling element during a broil cycle is around 20-25 watts/square inch. This broiling rate is sufficient to broil the food to provide the food with the desired interior and exterior characteristics, such as cooking the food all the way through and browning the exterior of the food, within a reasonable amount of time. According to an embodiment of the invention, the controller 40 may control the gas heating element 50 and the electric heating element 52 according to the method 200 of FIG. 3 to provide a radiation system that broils a food item such that the food item has interior and exterior characteristics similar to that obtained with a traditional electric oven broiling cycle, even though individual elements of the radiation system have a broiling rate less than 20-25 watts/square inch.

For example, a lower power electric heating element having a thermal output of 10 watts/square inch is generally not capable of providing a broiling rate sufficient to broil food to provide the food with the same interior and exterior characteristics that can be obtained using a traditional electric oven broiling element having a broiling rate of 20-25 watts/square inch. The controller 40 of the oven 10 can control the gas heating element 50 and the electric heating element 52 such that the combined thermal radiation emitted from the top portions of the housing 19 of the cooking cavity 14 and the electric heating element 52 provide a combined broiling rate of 20-25 watts/square inch, even when the broiling rate of the electric heating element 52 itself is only 10 watts/square inch.

Figure 4:
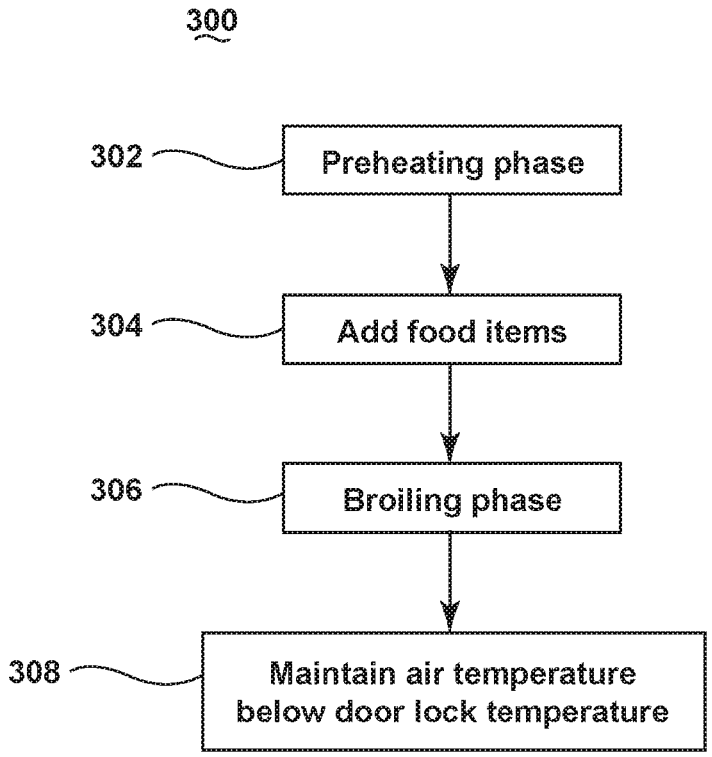
FIG. 4 is a flow chart illustrating an exemplary method for cooking items using an oven according to a fourth embodiment of the invention.

FIG. 4 illustrates a flow chart of an exemplary method 300 for use in implementing a broiling cycle of operation which may be used alone or in combination with the method 200 of FIG. 3. The method 300 begins with assuming that a user has selected a broiling cycle of operation through the user interface 42. The method 300 includes a preheating phase at 302 in which the cooking cavity 14 is preheated to a predetermined preheating temperature by activating the gas heating element 50 alone or in combination with the electric heating element 52 to heat the air in the cooking cavity 14 to the preheating temperature. At 304, the door 16 may be opened by a user and one or more food items may be placed inside the cooking cavity 14.

Following the preheating phase 302, a broiling phase may be implemented at 306 in which the electric heating element 52 is activated. At 308, the gas valve 56 may be selectively activated and deactivated to control the gas heating element 50 to maintain the air temperature within the cooking cavity 14 at a broiling temperature, which is below a door-lock temperature.

During the preheating phase 302, the gas heating element 50 and optionally the electric heating element 52 may be activated to heat the air in the cooking cavity 14 to a preheating temperature. The preheating temperature may correspond to an air temperature at which the top portions of the housing 19 of the cooking cavity 14 are sufficiently heated so as to emit thermal radiation, as discussed above with respect to method 200 of FIG. 3. In this manner, both the electric heating element 52 and the housing 19 contribute thermal radiation to broil the food item during the broiling phase 306. An exemplary range of preheating temperatures is 450-550° F.

The gas heating element 50 and the electric heating element 52 may be operated according to a duty cycle based on the selected broiling cycle, the temperature to which the air in the cooking cavity 14 is to be heated and/or the duration of the preheating phase. A duty cycle corresponds to the percentage of time power is supplied to the heating element, in the case of the electric heating element 52, or the percentage of time the gas valve 56 is open, in the case of the gas heating element 50, during a certain time interval, such as 1 minute for example. In one example, during the preheating phase 302, the electric heating element 52 may be activated at 100% duty cycle with the gas heating element 50 activated at 100% or less duty cycle. The duty cycle of the gas heating element 50 and optionally the electric heating element 52 may be selected so as to minimize overshooting the desired air temperature or to decrease the duration of the preheating phase, for example.

At or near the end of the preheating phase 302 and/or the beginning of the broiling phase 306, the controller 40 may indicate to the user to place the food in the cooking cavity 14. The indication to the user may be visual, such as by an indicator light or timer, or audible, such as through an alarm, for example. While the method 300 is discussed in the context of placing the food in the cooking cavity 14 at some time point after the start of the preheating phase 302, it will be understood that the method 300 may also be used in a similar manner when the food is placed into the cooking cavity 14 prior to or at the start of the preheating phase 302.

During the broiling phase 306, the electric heating element 52 is activated at 100% duty cycle. The gas heating element 50 may be selectively activated and deactivated at a predetermined duty cycle to maintain the temperature of the air in the cooking cavity 14 at a predetermined broiling temperature. The broiling temperature may correspond to a cooking temperature required to cook the food in the cooking cavity based on the selected cycle of operation or a user selected temperature, and may be the same or different than the preheating temperature. The broiling temperature may correspond to a set point around which the air in the cooking cavity 14 is maintained or a threshold temperature value above which the temperature of the air is maintained. The broiling temperature may be maintained at 308 such that the temperature of the air inside the cooking cavity 14 is less than a temperature at which the door lock 64 would be required to be activated to prevent a user from opening the door 16 and gaining access to the cooking cavity 14. The door lock temperature may be a temperature set by a government, regulatory or standards agency, such as Underwriters Laboratories Inc. (UL®), for example. According to one embodiment, the door lock 64 is activated if the air temperature in the cooking cavity 14 is greater than 600° F.

In order to balance cost and power requirement concerns, the electric heating element 52 is likely to be a lower power heating element which will require a 100% duty cycle to provide the desired thermal output during the preheating and/or the broiling phase. However, it is within the scope of the invention for higher power heating elements to also be used and thus the duty cycle for providing the desired thermal output from a higher power heating element may be less than 100%.

FIGS. 5A-D illustrate exemplary temperature vs. time graphs for various broiling cycles. The graphs in FIGS. 5A-D do not represent actual data but are rather idealized graphs based on actual data for the purposes of illustration. FIGS. 5A-D illustrate the temperature in the broiling zone and the air temperature within the cooking cavity 14 of the oven 10 over time. The broiling zone temperature is an average of the sensor readings obtained from multiple temperature sensors spaced across a broiling pan placed in the in the broiling zone under the electric heating element 52. The air temperature of the cooking cavity 14 is determined from the average of multiple temperature sensors placed within the cooking cavity 14.

Figure 5A:
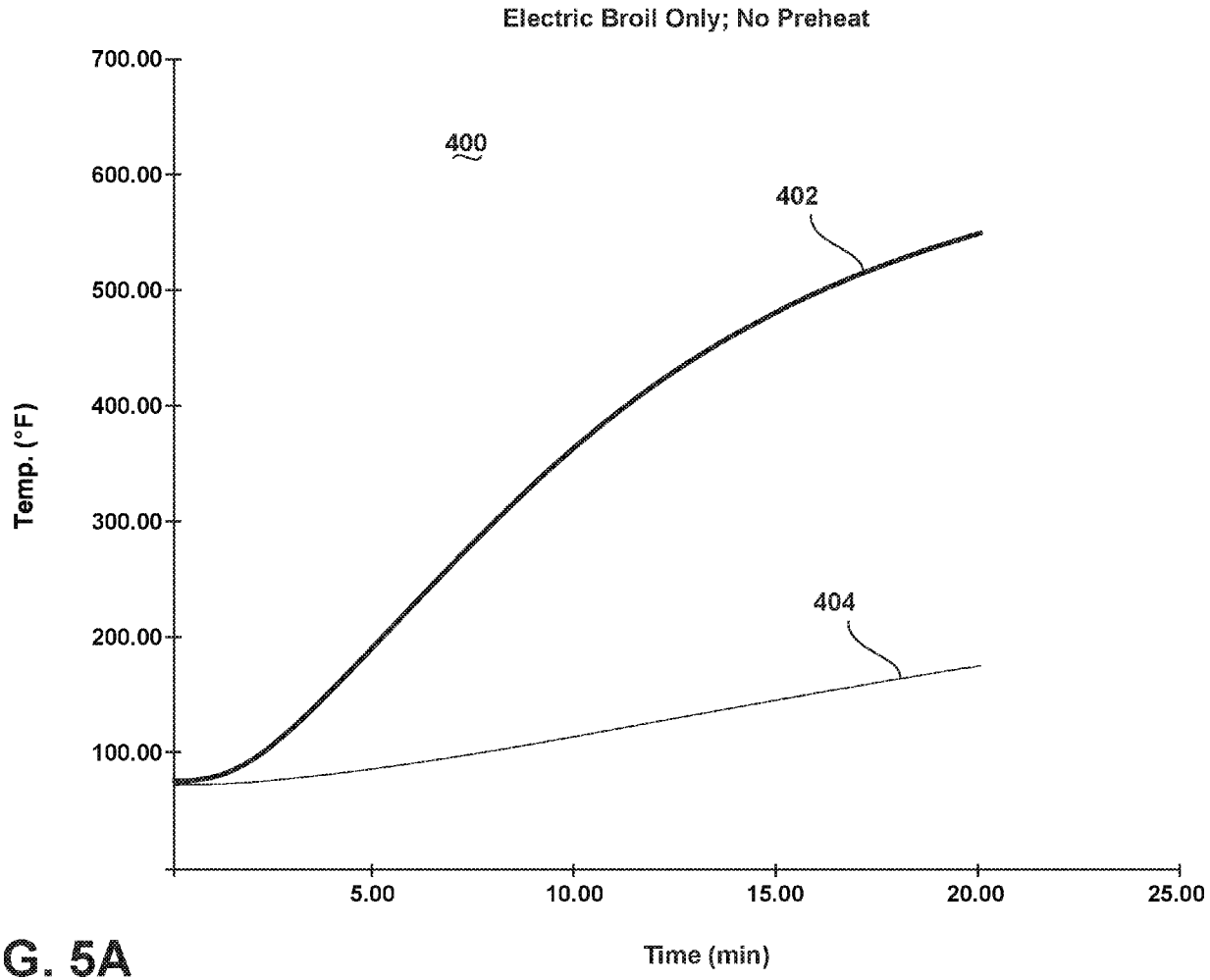
FIG. 5A is a graphical representation of temperature data in an oven during a broiling cycle using an electric broiling element.

FIG. 5A illustrates graphs for a broiling cycle 400 of the broiling zone temperature 402 and the air temperature 404 for a broiling cycle in which only the electric heating element 52 is activated during a broiling phase with no preheating of the cooking cavity 14. The average broiling zone temperature over the course of the broiling cycle 400 is 326° F. and the average air temperature is 114° F.

Figure 5B:
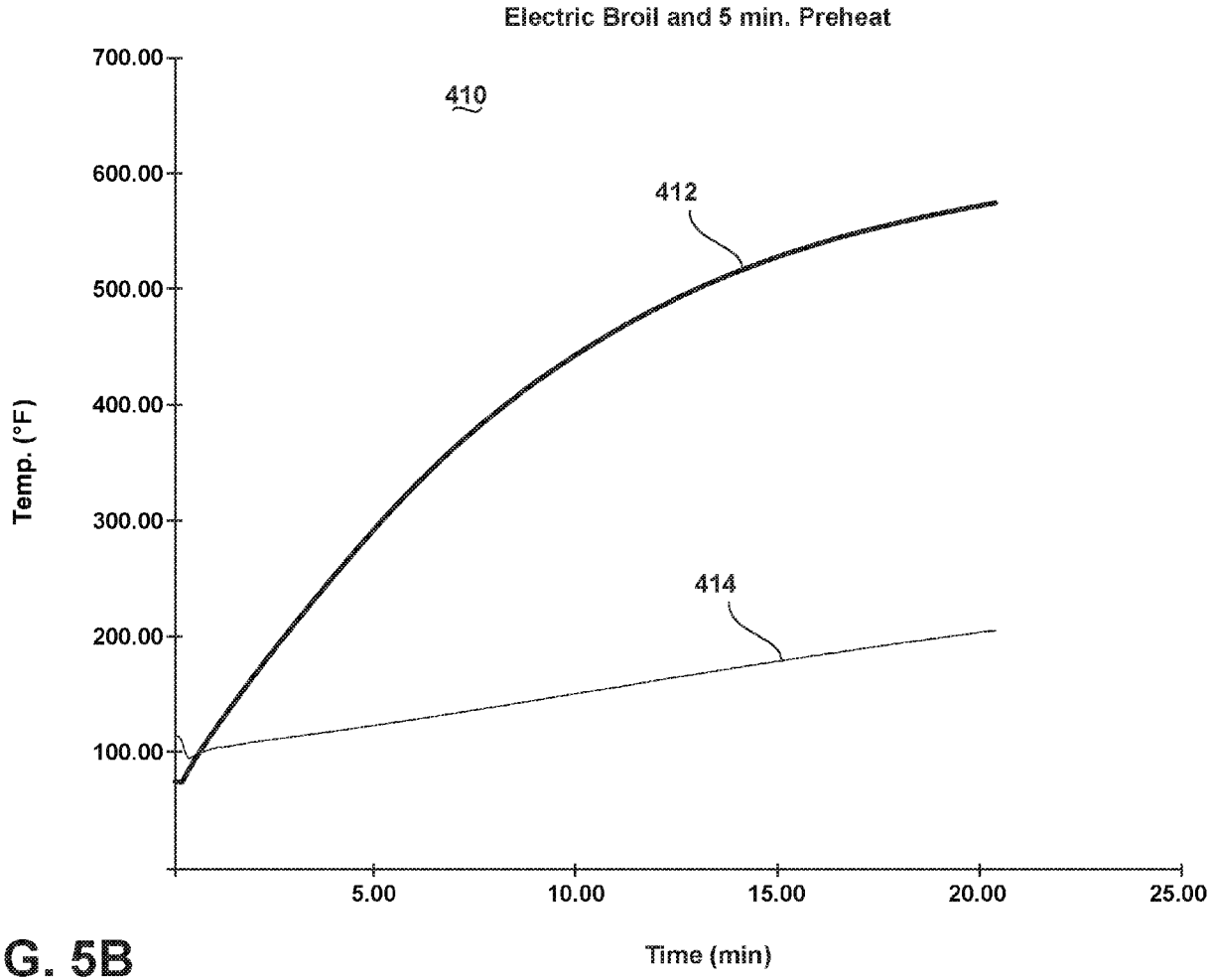
FIG. 5B is a graphical representation of temperature data in an oven during a broiling cycle using an electric broiling element during a preheating phase and a broiling phase of the broiling cycle.

FIG. 5B illustrates a broiling cycle 410 in which the oven is preheated with the electric heating element 52 for 5 min. during a preheating phase prior to a broiling phase with the electric heating element 52. The broiling zone temperature over time is illustrated by graph 412 and the air temperature of the cooking cavity is illustrated as graph 414. The average broiling zone temperature over the course of the broiling cycle 410 is 393° F. and the average air temperature is 146° F.

Figure 5C:
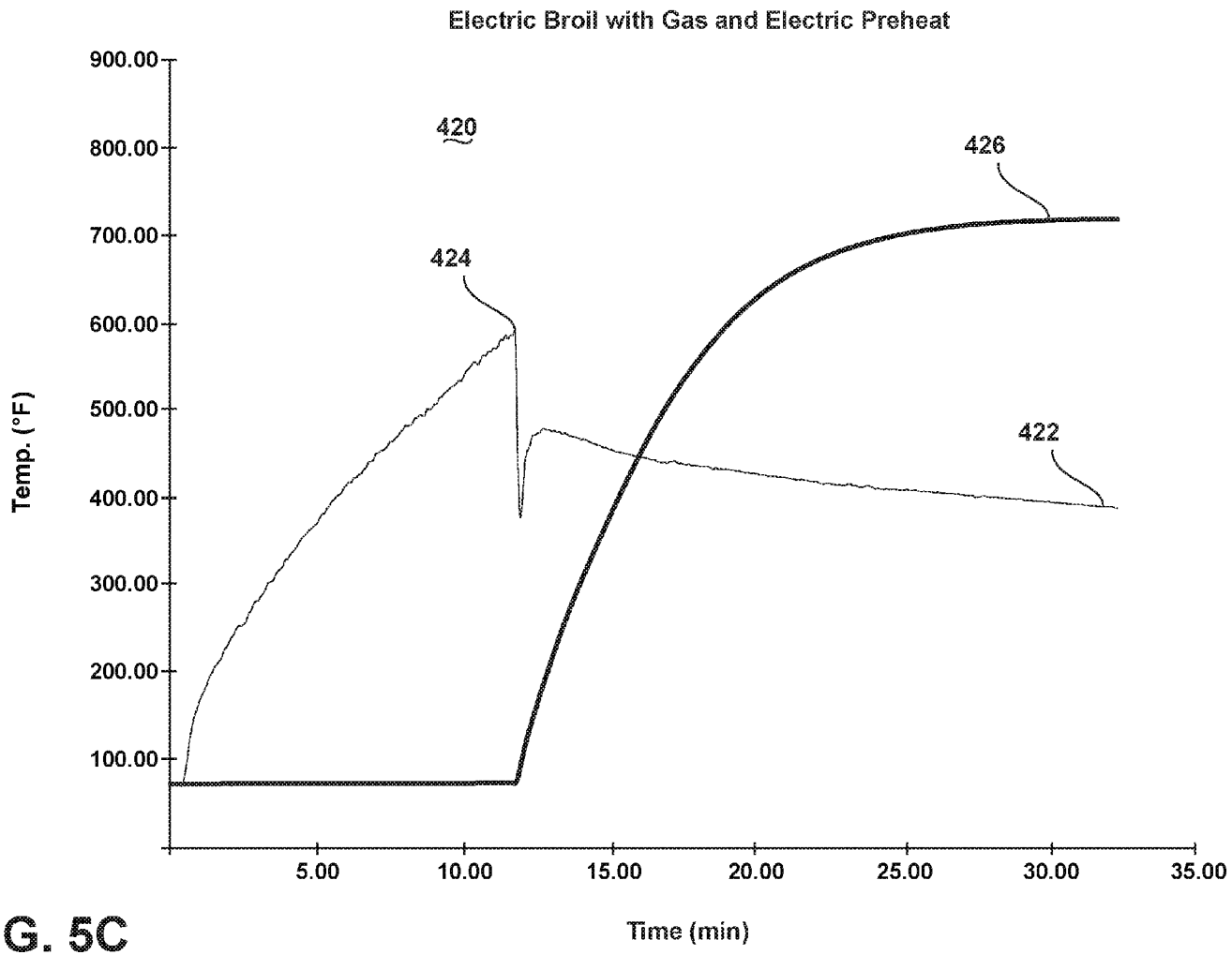
FIG. 5C is a graphical representation of temperature data in an oven during a broiling cycle using an electric broiling element and gas broiling element during a preheating phase and using the electrical broiling element during a broiling phase according to an embodiment of the invention.

FIG. 5C illustrates a broiling cycle 420 in which the oven is preheated for approximately 11 min. with the gas heating element 50 and the electric heating element 52 during a preheating phase prior to opening the oven door 16 and placing the broiling pan in the cooking cavity 14 in the broiling zone. As illustrated by the air temperature graph 422, the temperature of the air inside the cooking cavity 14 increases until the end of the preheating phase at 424, at which time the gas heating element 50 is deactivated, the broiling pan is placed in the cooking cavity 14 and the electric heating element 52 remains activated during a broiling phase of the cycle. The decrease in the air temperature at 424 is effected by the opening of the oven door 16 in which some of the heated air is released from the cooking cavity 14 and unheated air from the surrounding environment may enter the cooking cavity 14. The broiling zone temperature graph 426 illustrates the broiling zone temperature increase over time during the broiling phase with only the electric heating element 52 activated. The average broiling zone temperature over the course of the broiling cycle 420 is 578° F. and the average air temperature is 423° F.

Figure 5D:
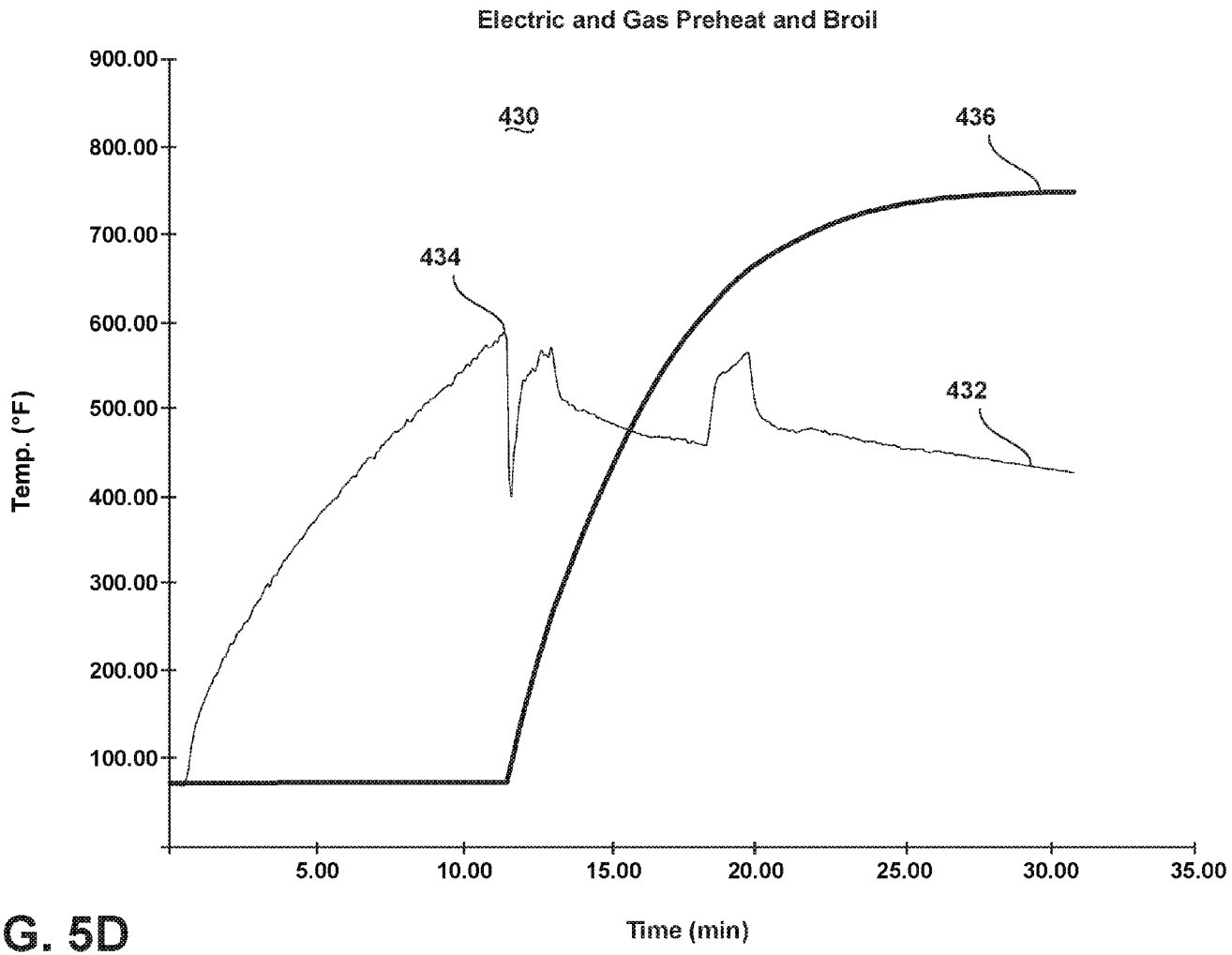
FIG. 5D is a graphical representation of temperature data in an oven during a broiling cycle using an electric broiling element and gas broiling element during a preheating phase and a broiling phase according to an embodiment of the invention.

FIG. 5D illustrates a broiling cycle 430 in which the oven is preheated for approximately 11 min. in a preheating phase by activating the gas heating element 50 and the electric heating element 52 prior to opening the oven door 16 and placing the broiling pan in the cooking cavity 14. As illustrated by the air temperature graph 432, the temperature of the air inside the cooking cavity 14 increases until the end of the preheating phase at 434, at which time the oven door 16 is opened and the broiling pan is placed in the cooking cavity 14 in the broiling zone and a broiling phase begins. The broiling zone temperature graph 436 illustrates the broiling zone temperature increasing during the broiling phase of the broiling cycle 430. The average broiling zone temperature over the course of the broiling cycle 430 is 599° F. and the average air temperature is 478° F.

During the preheating phase of broiling cycle 430, the temperature of the air inside the cooking cavity 14 is heated by both the gas heating element 50 and the electric heating element 52. The electric heating element 52 is run at a 100% duty cycle throughout the course of the broiling cycle 430. The gas heating element 50 is activated and deactivated during both the preheating and broiling phases based on the air temperature in the cooking cavity 14 as determined by the temperature sensor 30. In the illustrative example of FIG. 5D, the gas heating element 50 is activated and deactivated to maintain the air temperature within the cooking cavity 14 around a set point of 500° F. As may be seen in the air temperature graph 432, the temperature of the air in the cooking cavity 14 decreases when the door 16 is opened at 434 and heated air may escape from inside the cooking cavity 14 and unheated air from the surrounding environment may enter the cooking cavity 14. When the temperature of the air inside the cooking cavity 14 decreases below 500° F., the controller 40 activates the gas heating element 50 to increase the temperature of the air to 500° F.

It will be understood that there may be some fluctuation in the air temperature based on the manner in which activation and deactivation of the gas heating element 50 is controlled, delay time in heating of the air in the cooking cavity 14 subsequent to activation of the gas heating element 50, and/or overshoot of the temperature set point by the activation of the gas heating element 50, as is known in the art.

As summarized in Table 1 below, preheating the cooking cavity 14 with both the gas heating element 50 and the electric heating element 52 provides a much higher average broiling zone temperature and average air temperature than a broiling cycle using just the electric heating element 52 alone. In addition, selectively activating the gas heating element 50 throughout the duration of the broiling cycle even after the preheating phase to maintain the air temperature around a predetermined set point provides the highest average broiling zone temperature and average air temperature of the broiling cycles tested.

TABLE 1

Average Broiling Zone and Air Temperature During Broiling Cycles

| | Electric heating element only; no preheating (FIG. 5A) | Electric heating element only plus 5 min. preheating (FIG. 5B) | Electric heating element activated during broiling; preheating with electric and gas heating elements (FIG. 5C) | Electric and gas heating elements activated during broiling; preheating with electric and gas heating elements (FIG. 5D) |
|---|---|---|---|---|
| Average Broiling Zone Temperature | 326° F. | 393° F. | 578° F. | 599° F. |
| Average Air Temperature | 114° F. | 146° F. | 423° F. | 478° F. |

As illustrated by the data in Table 1, preheating the cooking cavity 14 to around 450-550° F. using both the gas heating element 50 and the electric heating element 52 increases the average broiling zone temperature and average air temperature, which Applicants have found provides for more even and consistent heating of the food. Maintaining the air temperature within the cooking cavity 14 at a predetermined temperature by selectively activating the gas heating element 50 during the broiling phase as well as the preheating phase of the cycle also contributes to a more even and consistent heating of the food compared to a traditional broiling cycle in which only the electric heating element is used.

Preheating the cooking cavity 14 to 450° F. or greater may also contribute to heating the top portions of the housing 19 such that the top portions of the housing 19 emit thermal radiation during the broiling cycle. In this manner, the food items may receive thermal radiation from both the electric heating element 52 and the housing 19, exposing the food items to higher thermal radiation than would be provided by the electric heating element 52 alone.

Typically, a gas oven includes a dedicated gas broiler, which includes a tubular burner, flame spreader, igniter, gas valve and other components needed for providing a flame directly over the food. These components of a gas broiler increase the cost of the oven. In addition, gas broilers concentrate heat over a smaller surface than an electric broiler, causing uneven broiling.

The embodiments of the invention described herein provide a gas oven with an electric heating element for broiling to provide more cost effective and even broiling. In a gas oven, the power and amperage available for use by an electric heating element during a broiling cycle may be limited due to the available energy from the energy supply source and the energy requirements of other components of the gas oven, limiting the thermal radiation emitted from the electric heating element during broiling. This limited thermal radiation may result in slower, less efficient and uneven broiling. The embodiments of the invention may be used to increase the thermal radiation during a broiling cycle by preheating the cooking cavity such that portions of the cooking cavity housing also radiate thermal energy. The combined thermal radiation from the electric heating element and the cooking cavity housing during the broiling phase may provide for a faster, more efficient and more even broiling than could be achieved using an electric heating element alone.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An oven comprising:

a housing defining a cooking cavity;

a door configured to open and close to provide access to the cooking cavity;

a gas heating element disposed only at a lower portion of the cooking cavity; and a low power electric heating element disposed only at an upper portion of the cooking cavity as a radiation system, wherein thermal radiation provided to the upper portion by the electric heating element alone is not enough to broil a food item in a predetermined broiling cycle of the oven.

2. The oven of claim 1 further comprising a controller configured to activate both the gas heating element and the electric heating element during a preheating phase of the broiling cycle.

3. The oven of claim 2 wherein at least one of the gas heating element or the electric heating element is continuously activated during the preheating phase.

4. The oven of claim 2 wherein both the gas heating element and the electric heating element are continuously activated during the preheating phase.

5. The oven of claim 4 wherein the electric heating element is continuously activated during a broiling phase of the broiling cycle, subsequent to the preheating phase.

6. The oven of claim 5 wherein the controller is coupled to a door-lock for selectively preventing access to the cooking cavity when a temperature in the cooking cavity is greater than 600° F.

7. The oven of claim 6 wherein a preheating temperature during the preheating phase is greater than 450° F.

8. The oven of claim 1 comprising a door lock configured to selectively lock and unlock the door, wherein the gas heating element is selectively activated and deactivated to maintain an air temperature within the cooking cavity at a broiling temperature, the broiling temperature being less than a door-lock temperature at which the door lock is activated.

9. An oven comprising:

a housing defining a cooking cavity;

a door configured to open and close to provide access to the cooking cavity;

at least one gas heating element disposed at a lower portion of the cooking cavity;

an electric heating element disposed at an upper portion of the cooking cavity; and a controller coupled to the at least one gas heating element and to the electric heating element and configured to implement a broiling cycle that includes activating the at least one gas heating element to heat air in the cooking cavity such that thermal radiation is emitted from a top portion of the housing at a broiling rate and activating the gas heating element;

wherein the thermal radiation from the top portion of the housing and the activated electric heating element during the broiling cycle form a combined thermal radiation that provides a combined broiling rate sufficient to broil food.

10. The oven of claim 9 wherein the controller is configured to activate both the at least one gas heating element and the electric heating element during a preheating phase of the broiling cycle.

11. The oven of claim 10 comprising a door lock coupled with the controller and configured to selectively lock and unlock the door, wherein the controller is configured to selectively activate and deactivate the gas heating element to maintain an air temperature within the cooking cavity below a door-lock temperature at which the door lock is activated.

12. The oven of claim 11 wherein the door-lock temperature is greater than 600° F.

13. The oven of claim 11 wherein the controller is configured to continuously activate the electric heating element.

14. The oven of claim 11 wherein the controller is configured to selectively activate and deactivate the gas heating element to maintain the air temperature within the cooking cavity at a broiling temperature, the broiling temperature being less than the door-lock temperature.

15. The oven of claim 9 wherein the electric heating element has a thermal output of 10 watts/square inch or less.

16. An oven comprising:

a housing defining a cooking cavity;

a door configured to open and close to provide access to the cooking cavity;

a door lock configured to selectively lock and unlock the door;

at least one gas heating element disposed at a lower portion of the cooking cavity;

an electric heating element disposed at an upper portion of the cooking cavity; and a controller coupled to the at least one gas heating element, the electric heating element, and the door lock;

wherein the controller is configured to implement a broiling cycle that includes a preheating phase and a subsequent broiling phase, the preheating phase comprising activating the at least one gas heating element and the electric heating element until a temperature in the cooking cavity reaches a preheating temperature;

wherein during the broiling phase, the controller is configured to continuously activate the electric heating element and selectively activate and deactivate the gas heating element to maintain an air temperature of the cooking cavity below a door-lock temperature at which the door lock is activated.

17. The oven of claim 16 wherein at least one of the gas heating element or the electric heating element is continuously activated during the preheating phase.

18. The oven of claim 16 wherein both the gas heating element and the electric heating element are continuously activated during the preheating phase.

19. The oven of claim 16 wherein a preheating temperature during the preheating phase is greater than 450° F.

20. The oven of claim 16 wherein the electric heating element has a thermal output of 10 watts/square inch or less.

* * * * *